US006926315B2

(12) United States Patent
Kondratuk

(10) Patent No.: US 6,926,315 B2
(45) Date of Patent: Aug. 9, 2005

(54) PUSH PULL LATCH BOLT MECHANISM

(75) Inventor: Michael W. Kondratuk, Cameron, WI (US)

(73) Assignee: Hardware Specialties, Inc., Spooner, WI (US)

( * ) Notice: Subject to any disclaimer, the term of this patent is extended or adjusted under 35 U.S.C. 154(b) by 0 days.

(21) Appl. No.: 10/352,323

(22) Filed: Jan. 29, 2003

(65) Prior Publication Data

US 2004/0145190 A1 Jul. 29, 2004

(51) Int. Cl.[7] ..... E05C 1/12

(52) U.S. Cl. ..... 292/165; 292/169; 292/170; 292/169.16; 292/358

(58) Field of Search ..... 292/165, 170, 292/169, 358, 169.16

(56) References Cited

U.S. PATENT DOCUMENTS 980,630 A * 1/1911 Granger ..... 292/170
2,124,099 A * 7/1938 Zagrzejewski ..... 292/170
2,939,737 A * 6/1960 Nygren ..... 292/170
4,007,954 A * 2/1977 Erickson ..... 292/165
5,157,953 A * 10/1992 Hung ..... 70/224

OTHER PUBLICATIONS

Wright Products for Inside Latch Assemblies for Push Button and Thumb Lever Handles, 10–11.

* cited by examiner

*Primary Examiner*—Gary Estremsky
(74) *Attorney, Agent, or Firm*—Moss & Barnett, P.A.

(57) ABSTRACT

The present invention relates to a latch bolt mechanism for a hinged door, and in particular, to a latch bolt mechanism actuated by push pull spindles. The latch bolt mechanism includes a bolt with an inclined surface, a housing, at least one push pull spindle with an inclined surface. The bolt is slideably mounted within the housing for movement between an extended position (extended outward from the housing) and a retracted position (positioned within the housing). The spindle slideably extends through an opening in the housing and bolt, transversely aligned with respect to the line of travel of the bolt. As the spindle is pushed towards or pulled away from the housing, the inclined surface of the spindle engages the inclined surface of the bolt to actuate movement of the bolt between the extended and retracted positions.

14 Claims, 16 Drawing Sheets

PUSH PULL LATCH BOLT MECHANISM

FIELD OF INVENTION

The present invention relates to a latch bolt mechanism for a hinged door, and in particular, a door latch mechanism actuated by push pull spindles.

RELATED ART

Latch bolt mechanisms are utilized to retain a door in a closed position until intentionally opened. These latch bolt mechanisms frequently utilize cams to extend and retract the bolt, although the cam may be actuated by rotary, lift, push, pull or trigger actuators. Cam operated latch bolt mechanisms can be complex, bulky and expensive to manufacture. Push or pull actuated latch bolt mechanisms are generally surface mounted to the interior side of a storm door, adjacent a main entrance door. As a result, the latch bolt mechanism hardware extends inward from the storm door and can interfere with the operation and/or closure of the main entrance door. These latches can also be somewhat unsightly. They may require a strike plate which would be visible even when the door is in a closed position. The strike plate may also interfere, or catch, a person as they exit or enter through the doorway.

Some prior art latch bolt mechanisms have utilized a lock mechanism that slideably engages an inclined surface of the bolt so that when the latch bolt is locked in its extended position, a force applied inward on the bolt, the inclined surfaces of the bolt engage the inclined surface of the lock and cause the lock mechanism to slide to its unlocked position, allowing retraction of the bolt. This defeats the purpose of a dead bolt lock and makes the latch mechanism less secure.

There is a need for a latch bolt mechanism that is: inexpensive to construct, compact in size with limited lateral projection to accommodate all door thickness applications and storm door use, simple in construction and flexible in use with all types of actuators. There is also a need for a push pull lock that functions as a true deadbolt lock and as a mortise push pull latch bolt mechanism that is symmetrical for use on both right and left handed doors without installer modification.

BRIEF SUMMARY OF THE INVENTION

The present invention relates to a latch bolt mechanism for a hinged door that utilizes push pull spindles rather than a cam to move the latch bolt. A latch bolt is slideably mounted within a housing. A spring or springs are mounted between the bolt and one end of the housing to bias the bolt in an extended position (extended outward from the housing), while permitting retraction of the bolt within the housing when an inward directed force is applied to the bolt. At least one spindle extends through the housing and bolt, transverse to the line of travel of the bolt. It may be desirable to accommodate two spindles, one from each side, in certain applications. The spindles have angled surfaces designed to engage corresponding inclined surfaces defined by the bolt. An inward force ("push") is applied to a spindle, causing the inclined surface of the spindle to engage the inclined surface of the bolt. The energy from movement of the spindle is translated to the bolt, causing the bolt to overcome the force of the spring bias and move from the extended position to a retracted position within the housing. Upon release of the force on the spindle, the force of the spring causes the bolt and spindle to return to their original positions. It is also possible to arrange the spindles so that an outward force ("pull") applied to the spindle will cause an inclined surface of the spindle to engage an inclined surface of the bolt to move the bolt to its retracted position.

The push pull latch bolt mechanism can be used with various types of external actuators, including without limitation, trigger, rotary, push, pull and lift. A lock mechanism may be slideably mounted to the housing for movement in a direction transverse that of the line of travel of the latch bolt. The bolt slides back and forth past the lock until such time as the lock is pushed into a recess in the bolt, securing the bolt in a locked position. The bolt cannot be retracted by applying a force to the bolt; the bolt can only be retracted upon movement of the lock back to its unlocked position. This arrangement creates a true deadbolt, a bolt incapable of being unlocked unless the lock itself is intentionally released.

DETAILED DESCRIPTION OF THE INVENTION

The present invention of a simple bolt mechanism will be described as it applies to its preferred embodiment. It is not intended that the present invention be limited to the described embodiment. It is intended that the invention cover all modifications, equivalents and alternatives which may be included within the spirit and scope of the invention.

Figure 1:
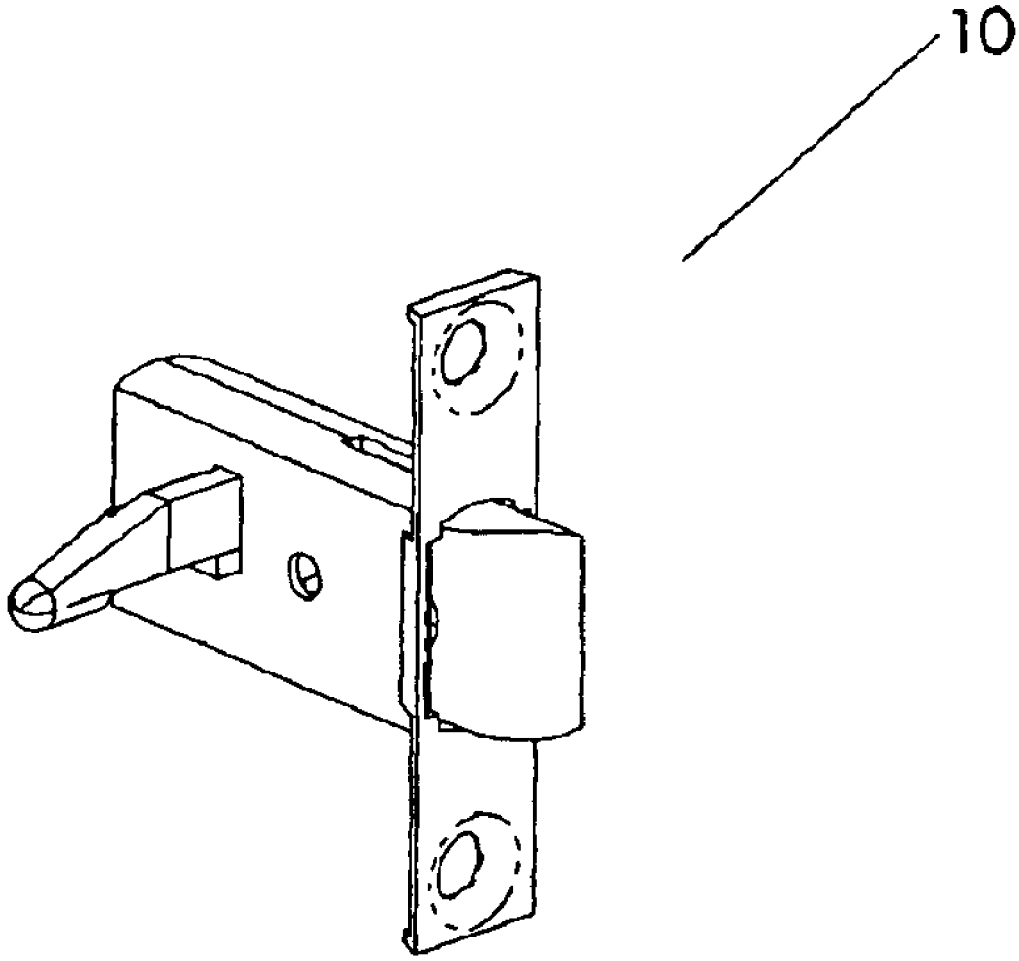
FIG. 1 is an isometric view of a preferred embodiment of a mortise version of the push pull latch bolt mechanism.

Referring now to the drawings, wherein like reference numerals and letters indicate corresponding structure throughout the several views, and referring in particular to FIG. 1, there is shown a push pull latch mechanism 10 according to the present invention. The latch bolt mechanism 10, as shown, is designed for installation as a mortise lock. It may be appreciated that the embodiment may be modified to be surface mounted as well.

Figure 2:
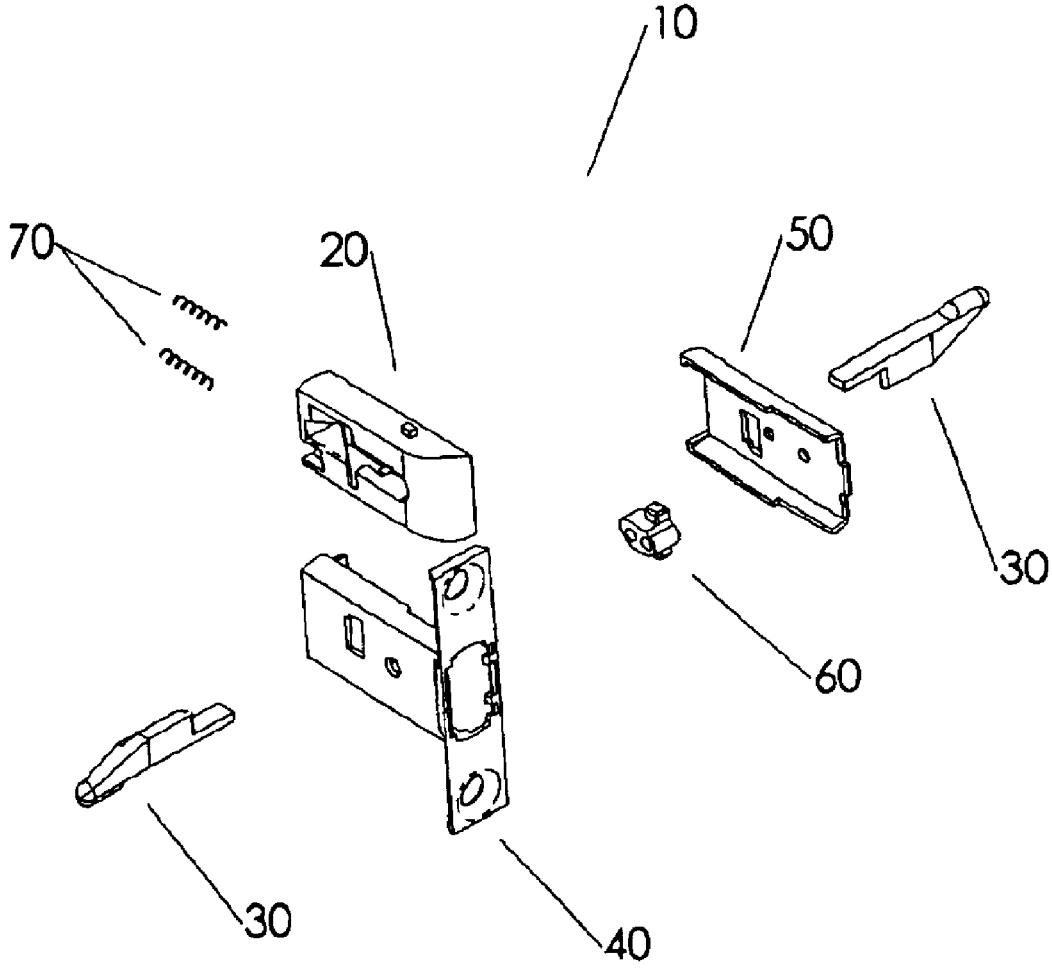
FIG. 2 is an exploded isometric view of the push pull latch bolt mechanism.

The general components of a preferred embodiment of the present invention are generally disclosed in FIG. 2. The push pull latch bolt mechanism 10 is comprised of a bolt 20, at least one push pull spindle 30, a housing 40 with a cover 50, an optional lock 60 and at least one spring 70. The bolt 20 is slideably mounted within the housing 40 for linear movement between an extended position (illustrated in FIG. 13) and a retracted position (illustrated in FIG. 16), and is secured in place by cover 50. Cover 50 is secured to the housing 40 by rivets, bolts or other means. In the preferred embodiment shown, two spindles 30 are slideably mounted through openings in the housing 40, cover 50 and bolt 20 for movement substantially transverse to the line of travel of the bolt 20. Lock 60 is slideably mounted within a lock guide channel 25 defined within bolt 20, for movement between a locked and an unlocked position. Springs 70 bias the bolt 20 in the extended position. Although two compression springs are shown, other types and number of springs may be used with the latch bolt mechanism, e.g., a single leaf spring.

Figure 9:
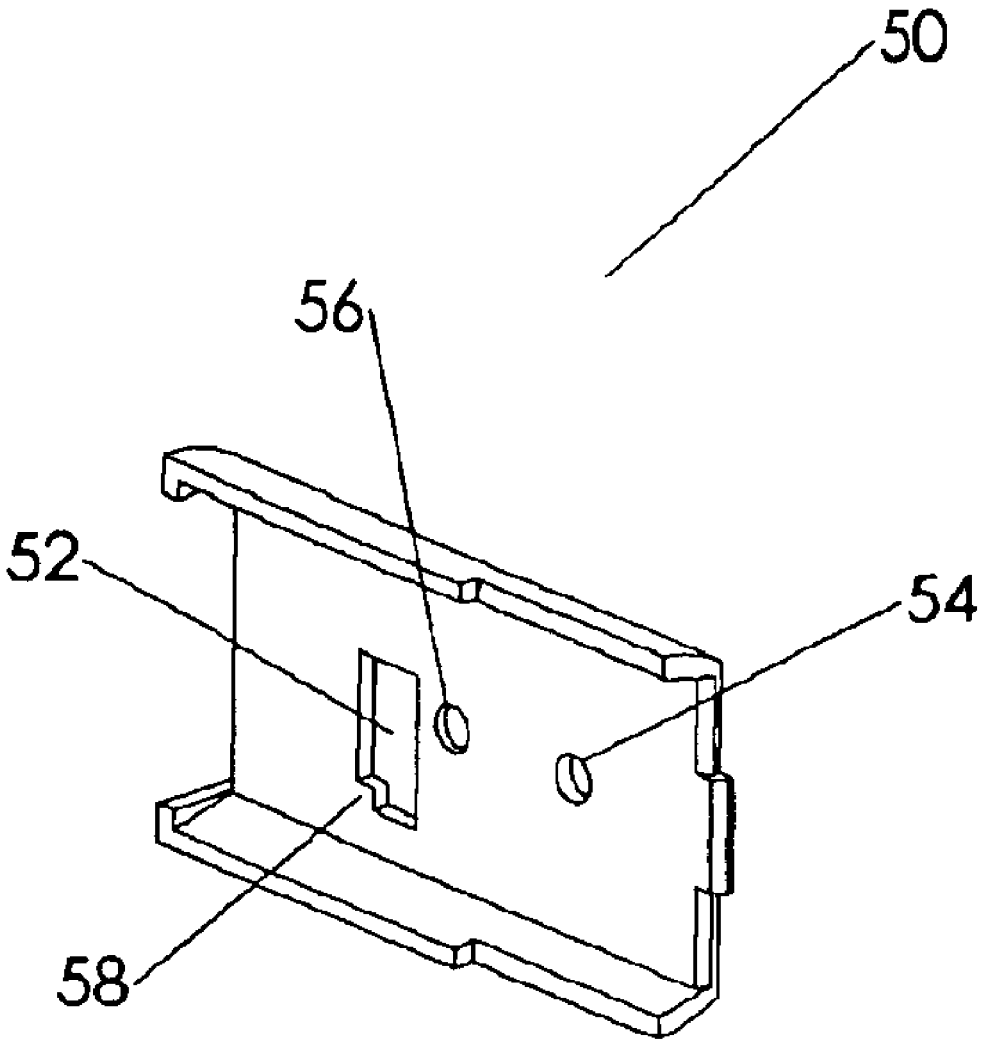
FIG. 9 is an isometric view of a cover component of the push pull latch bolt mechanism.

The cover 50 (FIG. 9) includes a spindle receptacle 52 for supporting and guiding the spindles 30, a lock guide receptacle 54 and a stake hole 56. The spindle receptacle 52 incorporates a cover corner obstruction 58 to prevent improper spindle orientation.

Figure 8:
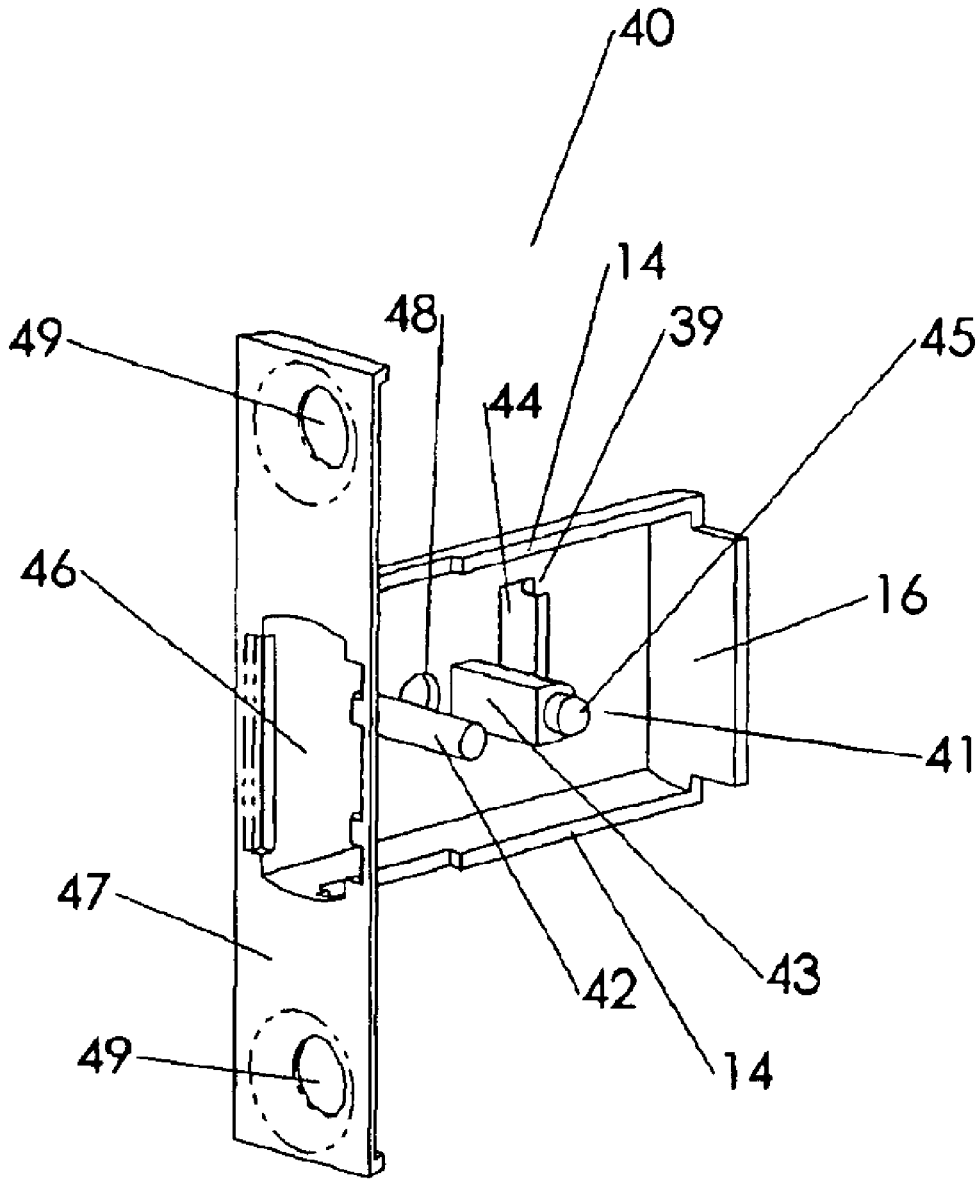
FIG. 8 is an isometric view of the housing component of the push pull latch bolt mechanism.

The housing 40 (FIG. 8) includes a support 41, a lock guide 42, a spindle opening 44, a spindle opening comer obstruction 39 to prevent improper orientation of the spindle with respect to the housing 40, a bolt opening 46, a face plate 47 with screw holes 49 for securing the latch mechanism to a door, and a lock access opening 48. Support 41 has a flat engagement surface 43 that acts as a stop upon engagement with lock 60, and also defines a generally cylindrical attachment stake 45 at its outer end for engaging the stake hole 56 in cover 50. The lock guide 42 and guide hole 64 of lock 60 (FIG. 10) are axially aligned so that the lock guide 64 is positioned over and supported by the housing guide 42. The free end of lock guide 42 is aligned and mates with lock guide receptacle 54 of cover 50 when cover 50 is secured to the housing 40. The actuation port 62 of lock 60 is also axially aligned with the housing lock access 48 to permit attachment of an external lock actuator (not shown) to the actuator port 62 of the lock 60 through actuation port 62. An external lock actuator is used to slide the lock 60 between the locked and unlocked positions, as discussed below.

The lock guide 42 and support 41 maintain the cover 50 in proper position with respect to the housing 40. When the housing 40 and cover 50 are secured together, the spindle receptacle 52 of cover 50 and the spindle opening 44 of the housing 40 are aligned for receiving and maintaining the spindles 30 in the proper orientation. The bolt 20 is slideably mounted between the housing 40 and cover 50.

Figure 12:
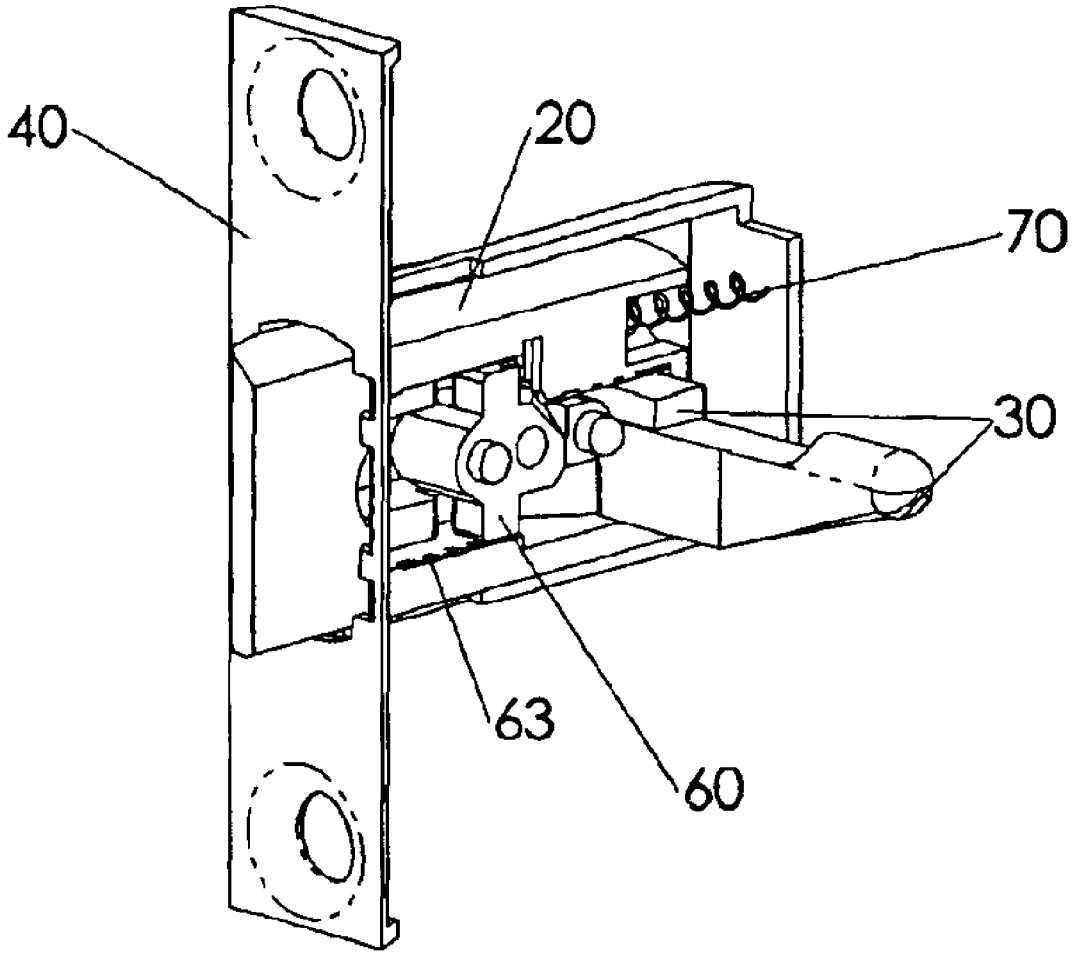
FIG. 12 is an isometric view of the latch bolt mechanism with the bolt in an extended position, with the housing cover removed.
Figure 14:
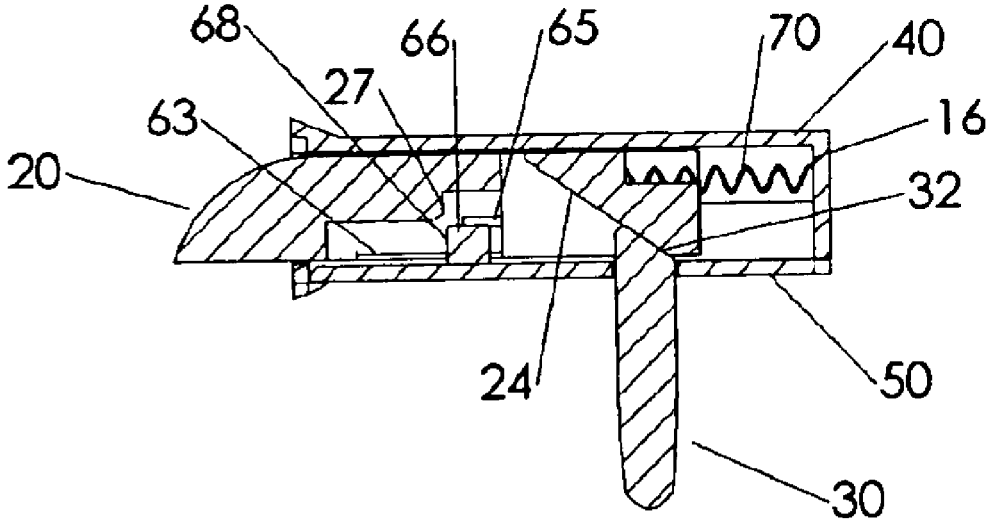
FIG. 14 is a view of the latch bolt mechanism of FIG. 13 taken along the line A—A, illustrating the contact between a spindle and the bolt.

The housing 40 includes side plates 14 and an end plate 16 for securing the bolt 20 within the housing 40. End plate 16 supports one end of springs 70 to bias the bolt 20 in its extended position, as shown in FIGS. 12 and 14.

Figure 3:
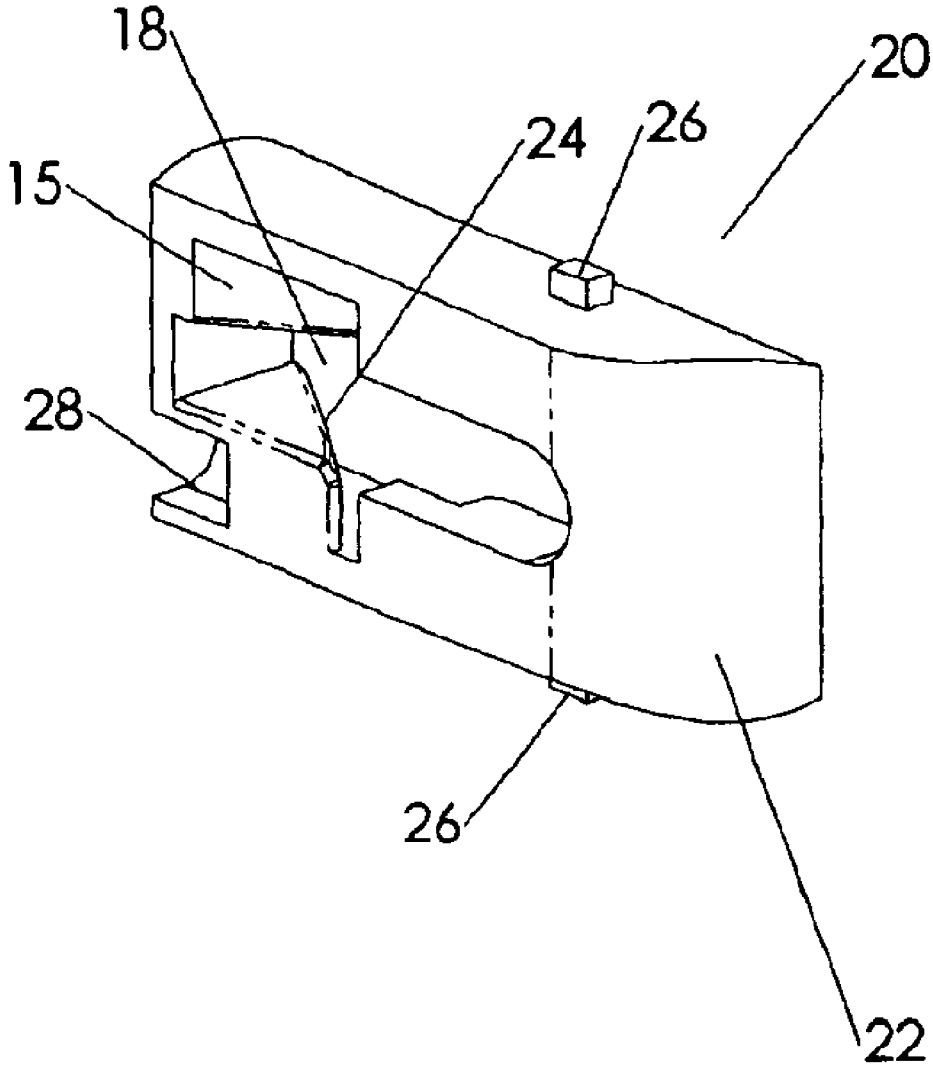
FIG. 3 is an isometric view of the bolt component of the push pull latch bolt mechanism.
Figure 4:
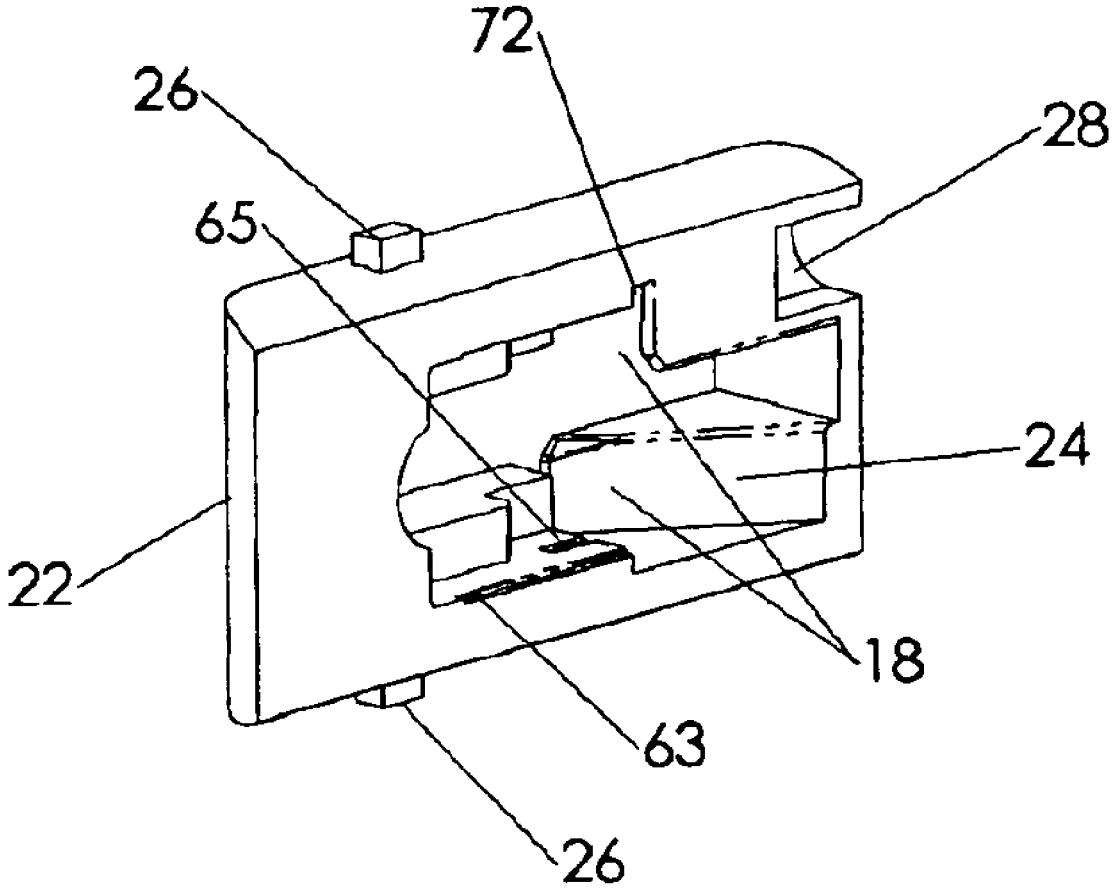
FIG. 4 is an isometric view of the bolt component of the push pull latch bolt mechanism from a side opposite that shown in FIG. 3.
Figure 6:
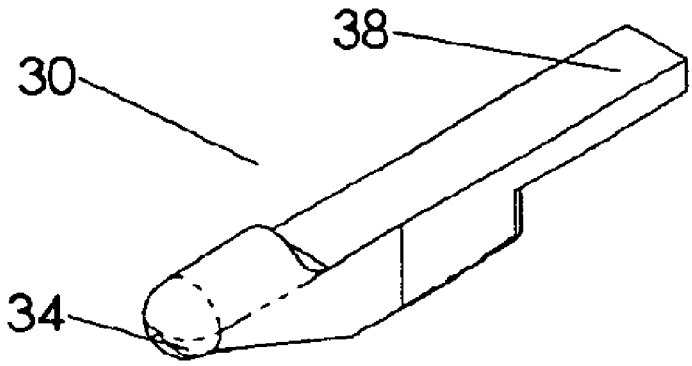
FIG. 6 is another isometric view of the spindle component of the push pull latch bolt mechanism.
Figure 5:
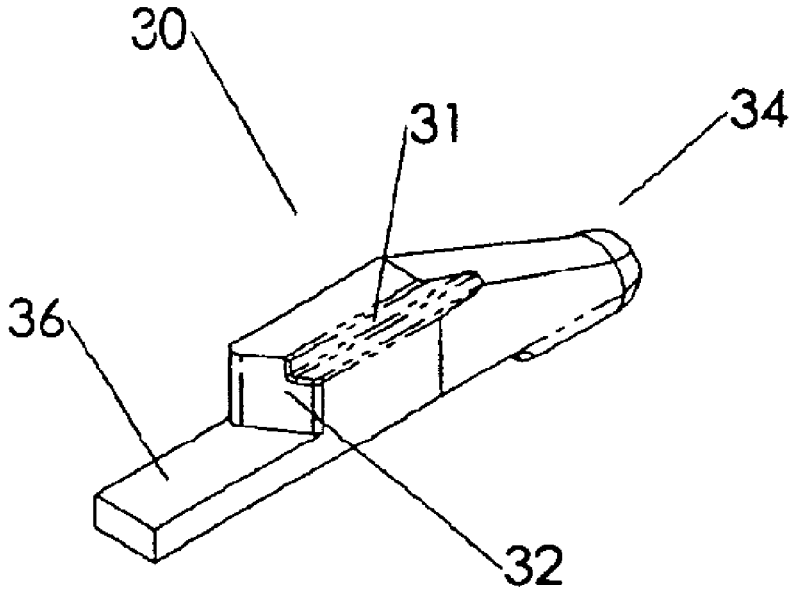
FIG. 5 is an isometric view of the spindle component of the push pull latch bolt mechanism.

Referring to FIGS. 3 and 4, the bolt 20 includes two actuation inclines or angled surfaces 24 and 15 that oppose each other. These actuation inclines are aligned at approximately 40 degree angles with respect to the line of travel of the bolt 20.

The spindles 30 include an interface surface 38, a semi-spherical free end 34 (other shapes are possible), a support surface 36 opposite that of interface 38, a orientation slot 31 that is aligned with the comer obstruction 39 of housing 40 or comer obstruction 58 of cover 50, and an inclined surface 32. When the housing 40, cover 50 and bolt 20 are assembled, spindle openings are created by the alignment of the housing spindle opening 44, the cover spindle receptacle 52 and the bolt spindle openings 18. The spindles 30 are inserted into the housing 40 from opposite sides of the housing 40, such that the inclined surfaces 32 of the spindles 30 are in contact with the actuation inclines 24 and 15 of bolt 20 and the semi-spherical ends 38 of the spindles 30 extend outwardly from the housing 40 for engagement with a handle (not shown). This is the normal or "home" position of the spindles.

Figure 15:
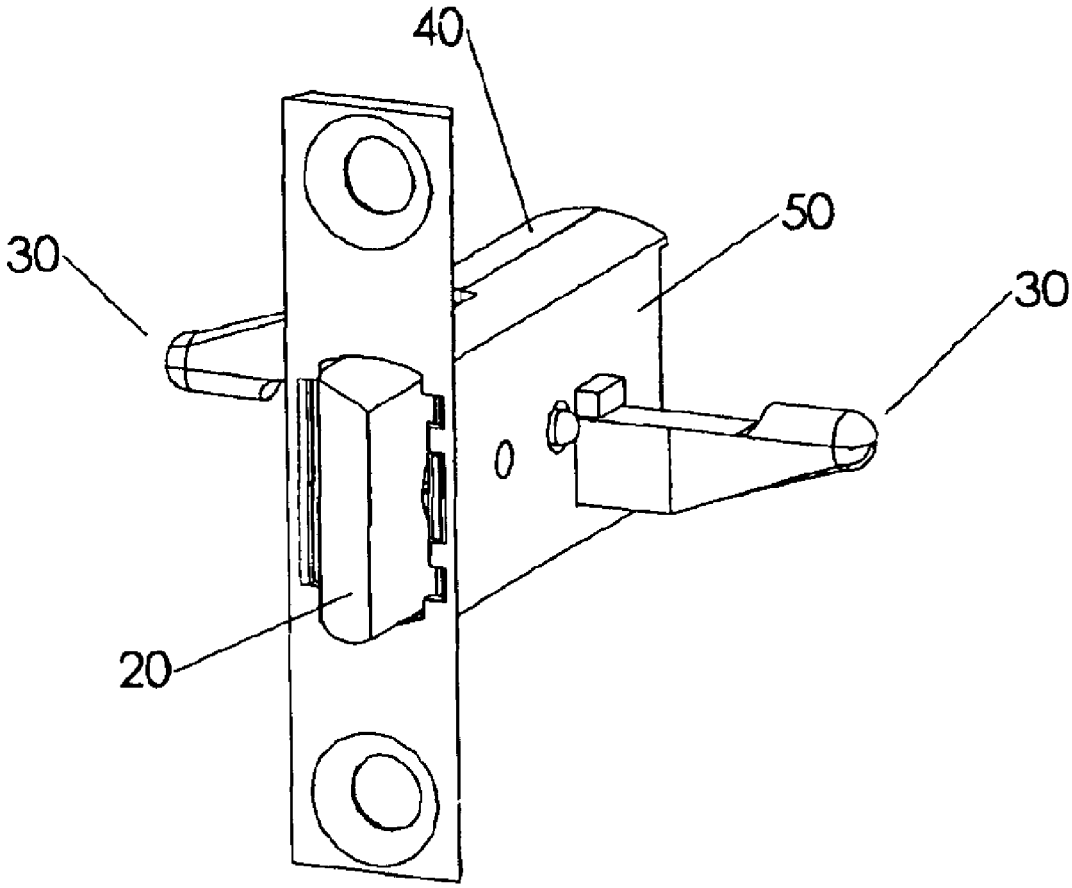
FIG. 15 is an isometric view of the latch bolt mechanism, illustrating the mortise plate, and the "home" position of the spindles with the bolt in its normal or extended position.
Figure 17:
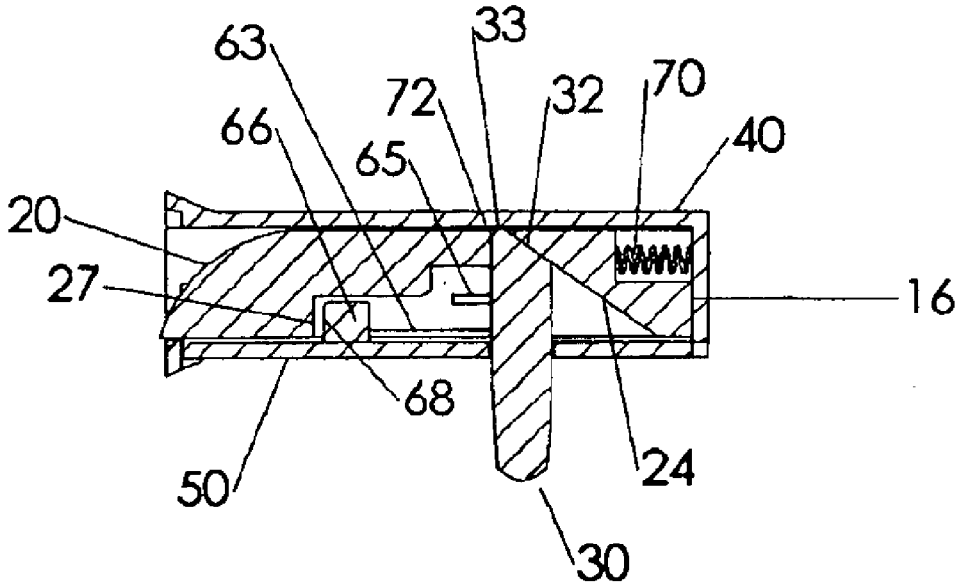
FIG. 17 is a view of the latch bolt mechanism of FIG. 16 taken along the line B—B, illustrating the contact between a spindle and the bolt.

The spindles 30 are mounted one on top of the other, facing in opposite directions, such that interface surfaces 38 of the spindles 30 are in contact with each other. The support surfaces 36 of spindles 30 are supported by the bolt 20 as it is moved between its retracted and extended positions. When an inward directed force is applied to a spindle 30 (directed towards the housing 40, left spindle 30 in FIG. 15), the spindle 30 (mounted from the side of the housing 40) is pushed into the housing 40, the inclined surfaces 32 of spindle 30 engages the inclined surface 15 of the bolt 20. When an inward directed force is applied to a spindle 30 mounted from the side of the cover 50 (right spindle 30 in FIG. 15), the spindle 30 is pushed into the cover 50 and the inclined surface 32 of spindle 30 engages the inclined surfaces 24 of the bolt 20. Movement of the inclined surfaces 32 of the spindles 30, transverse to the line of travel of the bolt 20, against the inclined surfaces 15 or 24 of the bolt 20, translates energy to the bolt 20 to cause retraction of the bolt 20 into the housing 40. The force asserted by the spindle 30 on bolt 20 overcomes the bias of springs 70 and translates to angular (generally perpendicular) movement of the bolt 20 from its (biased) extended position to its retracted position as shown in FIG. 17. The spindle interface surfaces 38, the spindle receptacle 52 in cover 50 and spindle opening 44 in housing 40 confine the translation of the spindles 30 to be angular to the movement of the bolt 20. When the force on the spindle 30 is released, the force of the springs 70 causes the bolt 20 to return to its extended position, and the spindle 30 to return to its home position. The spindles 30 are also independently operable, so that the door latch bolt mechanism can be opened from either side of the door.

Figure 7:
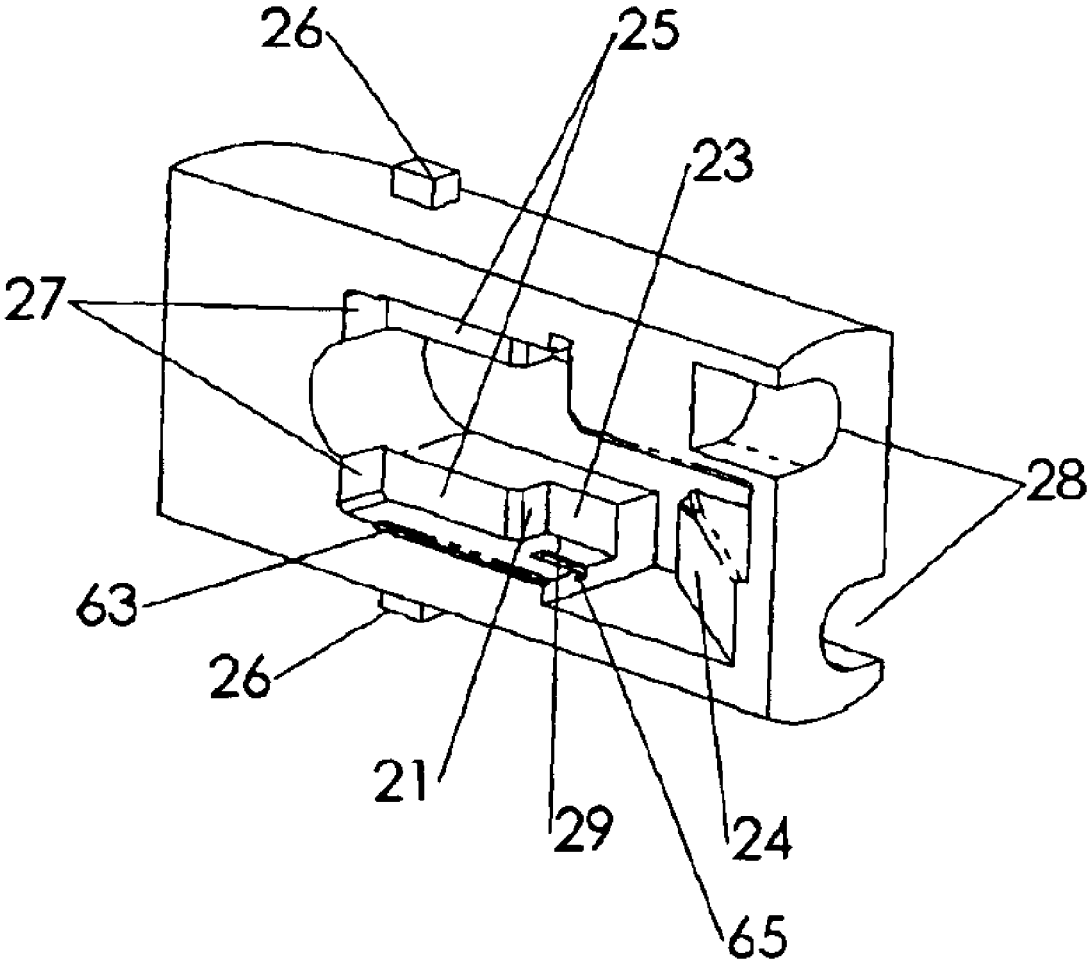
FIG. 7 is an isometric view of the bolt component of the push pull latch bolt mechanism.

Referring to FIGS. 4 and 7, bolt 20 includes a rounded strike contact surface 22 for engaging either a strike plate or door frame edge, (not shown), a flat locking surface 21 for engaging the placement stops 66 of lock 60, a lock stop surface 23 for engaging a stop surface 67 of the lock 60, opposing lock guide channels 25 to permit movement of the bolt 20 with respect to the lock 60, extension stops 26 for limiting the extension of the bolt 20 with respect to the housing 40, and staggered, opposite facing spring retainers 28 for engaging one end of the springs 70. When the bolt 20 is mounted within the housing 40, one end of the springs 70 nest within the spring retainers 28; the other end of the springs 70 engage the housing end plate 16 to bias the bolt 20 forward in its extended position.

Figure 10:
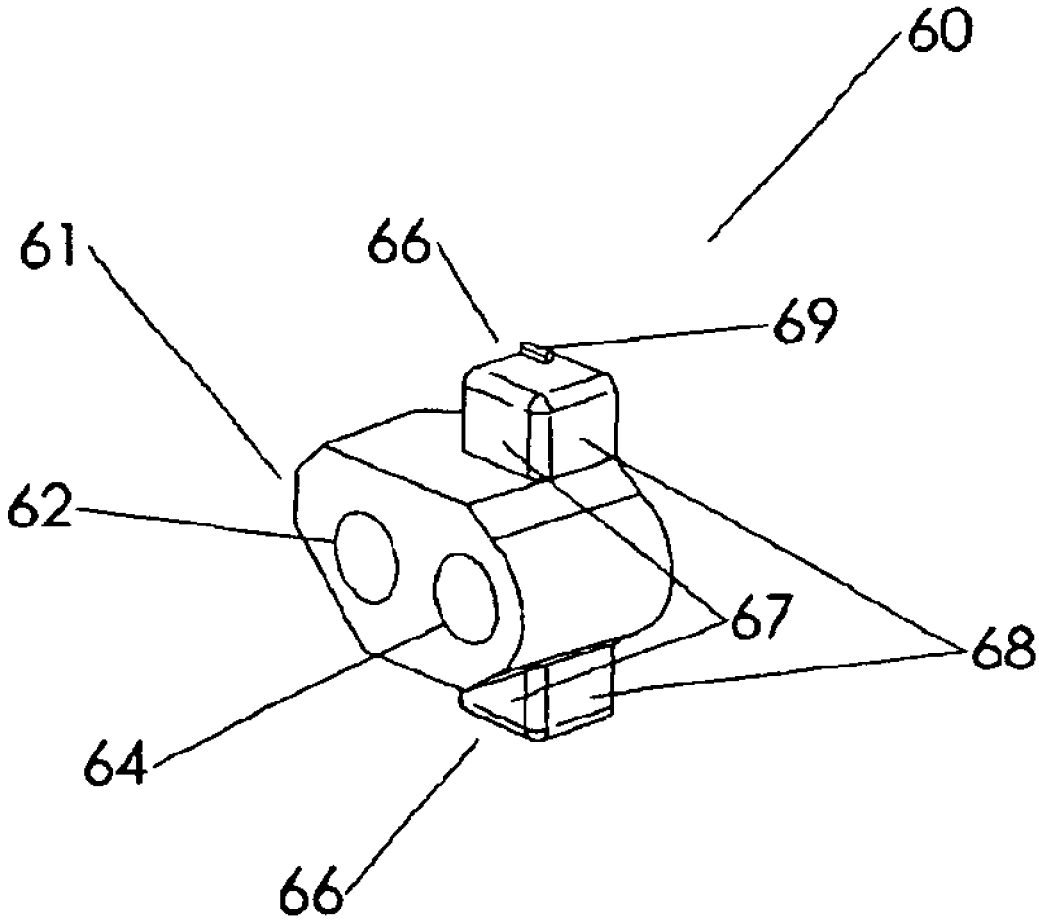
FIG. 10 is an isometric view of an optional lock component.
Figure 11:
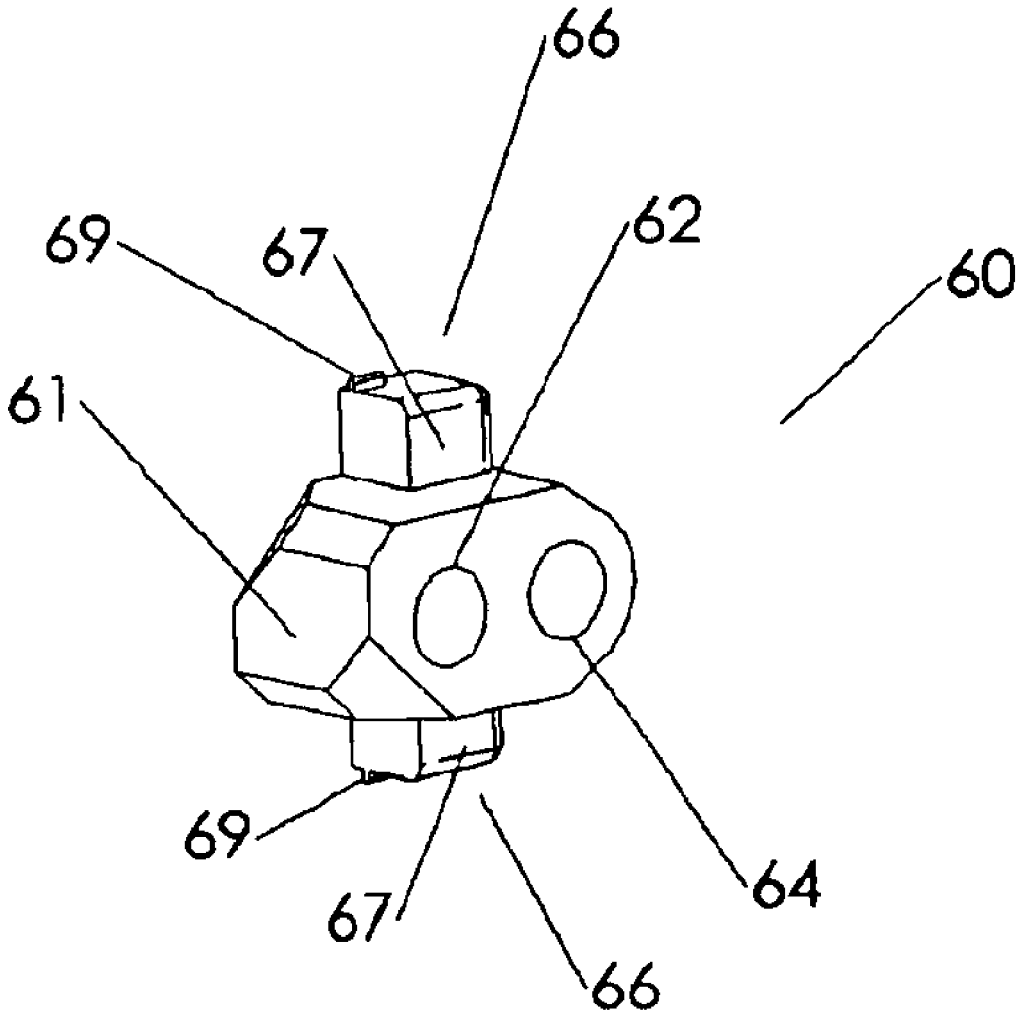
FIG. 11 is an alternate isometric view of the optional lock component shown in FIG. 10.

Referring to FIGS. 10 and 11, the lock 60 includes placement stops 66 with abutment surfaces 68 that engage guide channel end surfaces 27 of bolt 20 when bolt 20 is fully retracted, a lock actuation port 62 for attachment to an external lock actuator (not shown), a guide hole 64 for receiving housing lock guide 42, a bearing surface 61 to engage support engagement surface 43 of the housing, and a stop surface 67 for engaging lock stop surface 23 of bolt 20 when the lock 60 is moved to the locked position. The lock 60 is slideably mounted on the housing 40 with the free end of lock guide 42 of housing 40 extended through the guide hole 64 of lock 60. In this orientation, the lock 60 can only move axially with respect to the longitudinal axis of the lock guide 64, which is transverse to the direction of travel of the bolt 20.

Bolt 20 is slideably mounted with respect to housing 40 and lock 60. A lock guide channel is defined in bolt 20 (FIG. 7) to permit bolt 20 to move with respect to lock 60. The lock channel consists of two recessed, opposed lock guide channels 25 designed to receive the placement stops 66 of lock 60. Spindle clearance is provided by the bolt spindle opening 18 when the bolt 20 is in the extended position. Bolt 20 is free to move between the extended and retracted positions as long as the placement stops 66 of bolt 60 are in alignment within the lock guide channel 25 (the unlocked position of the lock 60).

The bolt 20 may be locked in its extended position by pushing the lock 60 inward along the longitudinal axis of the lock guide 42, so that the lock placement stops 66 are positioned within a locking recess 29 defined in bolt 20, in engagement with lock stop surfaces 23 of bolt 20. This constitutes the locked position of lock 60 and bolt 20. Engagement of the bearing surface 61 of lock 60 with the flat surface 43 of the housing support 41 helps guide the lock 60 when moved between its locked and unlocked position.

In the locked position, bolt 20 is prevented from retracting by the engagement of the lock tabs 66 with lock contact surface 21 of the bolt 20. In the locked position, a door can be secured in a closed orientation and spindles 30 become inoperable. The latch bolt mechanism 10 may be constructed with or without incorporation of the lock 60 as preferred.

The bolt 20 and lock 60 can also be designed with a catch mechanism to better securing the lock 60 in either the locked or unlocked orientation. On possible embodiment is illustrated in FIGS. 4 and 10. The lock 60 includes one or more catch pegs 69 that releaseably engage an unlocked catch channel 63 or locked catch channel 65 formed along the lock guide channels 25 of bolt 20. When bolt 20 is moved between the extended position and the retracted position with the lock 60 in the unlocked position, the catch peg 69 slides along the unlocked catch channel 63. This engagement prevents the lock 60 from unintentionally moving out of the unlocked position. When the bolt 20 is in the extended position, the lock 60 may be moved to the locked position. The material of which the bolt 20 and/or the lock 60 are comprised allows some flex between the catch peg 69 and unlocked catch channel 63. Upon application of an external force on the lock 60 to move it from the unlocked position to the locked position, catch peg 69 will disengage the unlocked catch channel 63 and re-engage the locked catch channel 65. This secures the lock 60 in the locked position until another external force is applied to move lock 60 to the unlocked position.

Other methods may be employed to create a catch mechanism for the present invention. By way of example and not limitation, instead of catch channels, a raised area could be designed in the bolt (approximately midway between the location of where the catch channels were positioned), which would need to be overcome to permit movement between the locked and unlocked positions. Other catch mechanisms are anticipated.

Figure 13:
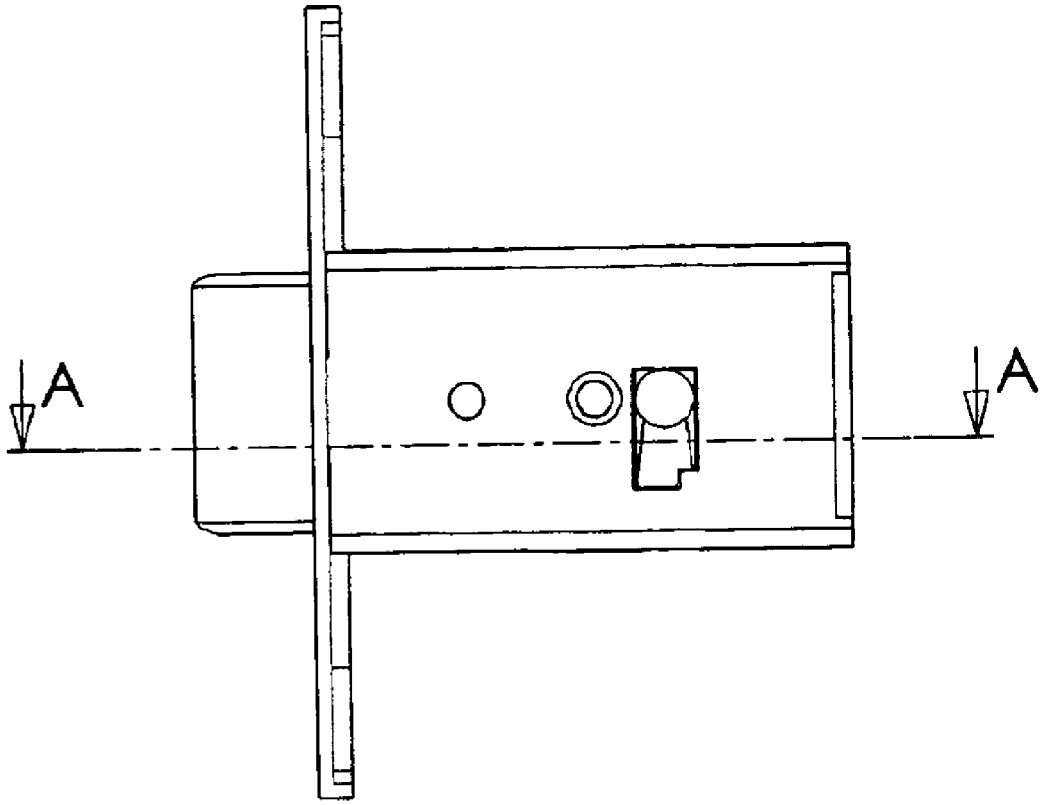
FIG. 13 is a (cover) side view of the latch bolt mechanism, with the bolt in its extended position and the spindle positioned to engage and retract the bolt.
Figure 16:
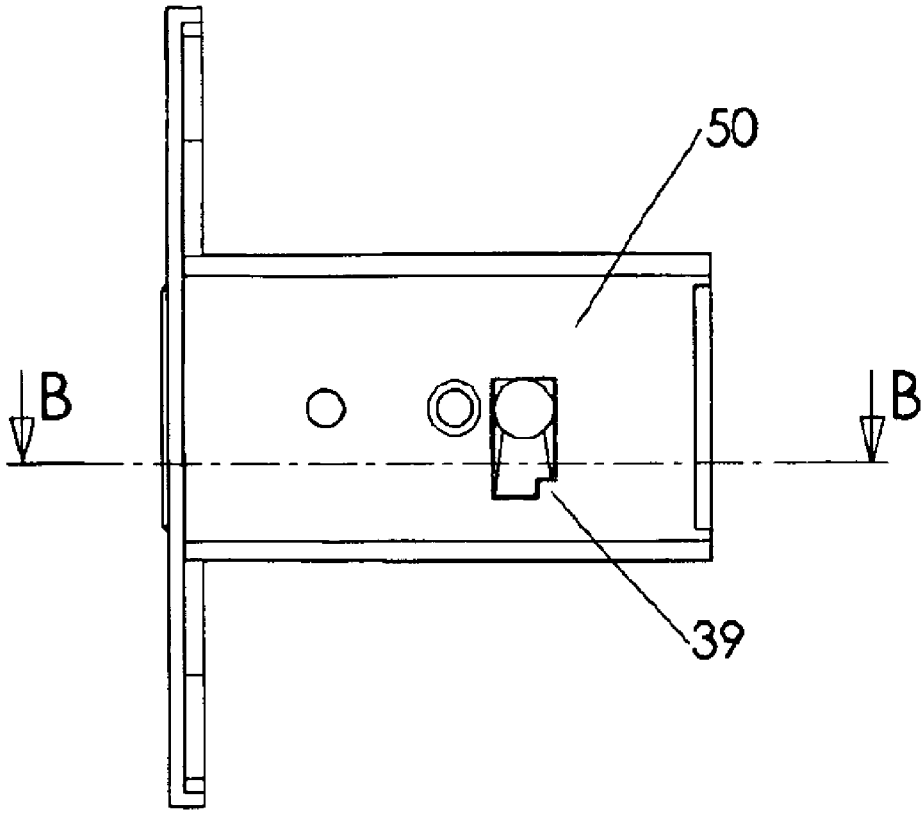
FIG. 16 is a (cover) side view of the latch bolt mechanism, with the bolt in its retracted position and the spindle engaging the bolt.

Operation of the push pull latch bolt mechanism 10 is illustrated in FIG. 14, a sectional view of the latch mechanism 10 as shown in FIG. 13, with bolt 20 extended. As the spindle is pushed towards the housing 40, incline surface 32 of spindle 30 engages the inclined surface 24 of the bolt 20, causing bolt 20 to be retracted towards the end plate 16 of the housing 40, compressing springs 70. The result is shown in FIGS. 16 and 17, illustrating bolt 20 in its retracted position, with springs 70 compressed and a leading tip 33 of inclined surface 32 of spindle 30 extending partially through the spindle extension opening 72.

Figure 18:
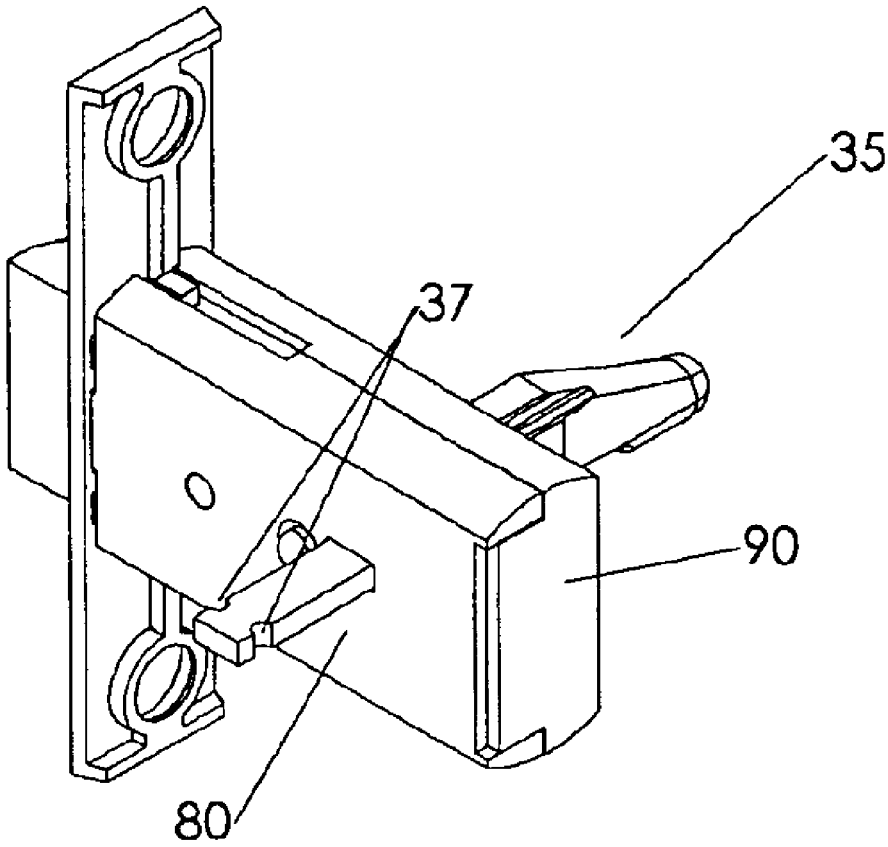
FIG. 18 is a an isometric view of the latch bolt mechanism with the bolt in an extended position, illustrating a modified version of the spindle for "pull" actuation of the bolt to its retracted position.
Figure 19:
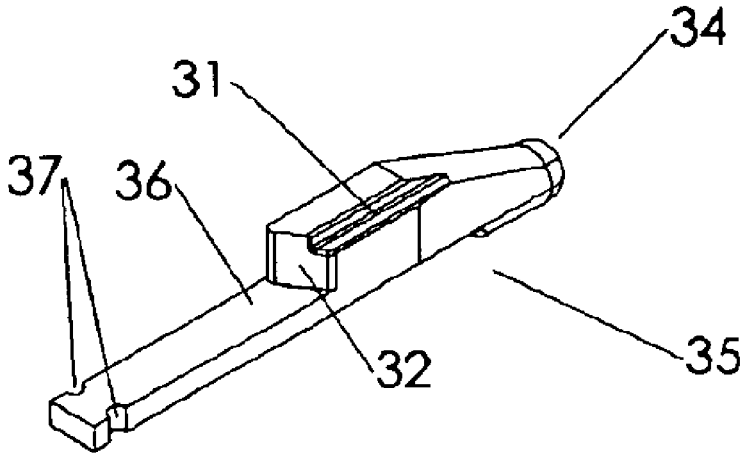
FIG. 19 is an isometric view of an alternate embodiment of the spindle used to "pull" actuation of movement of the bolt.
Figure 20:
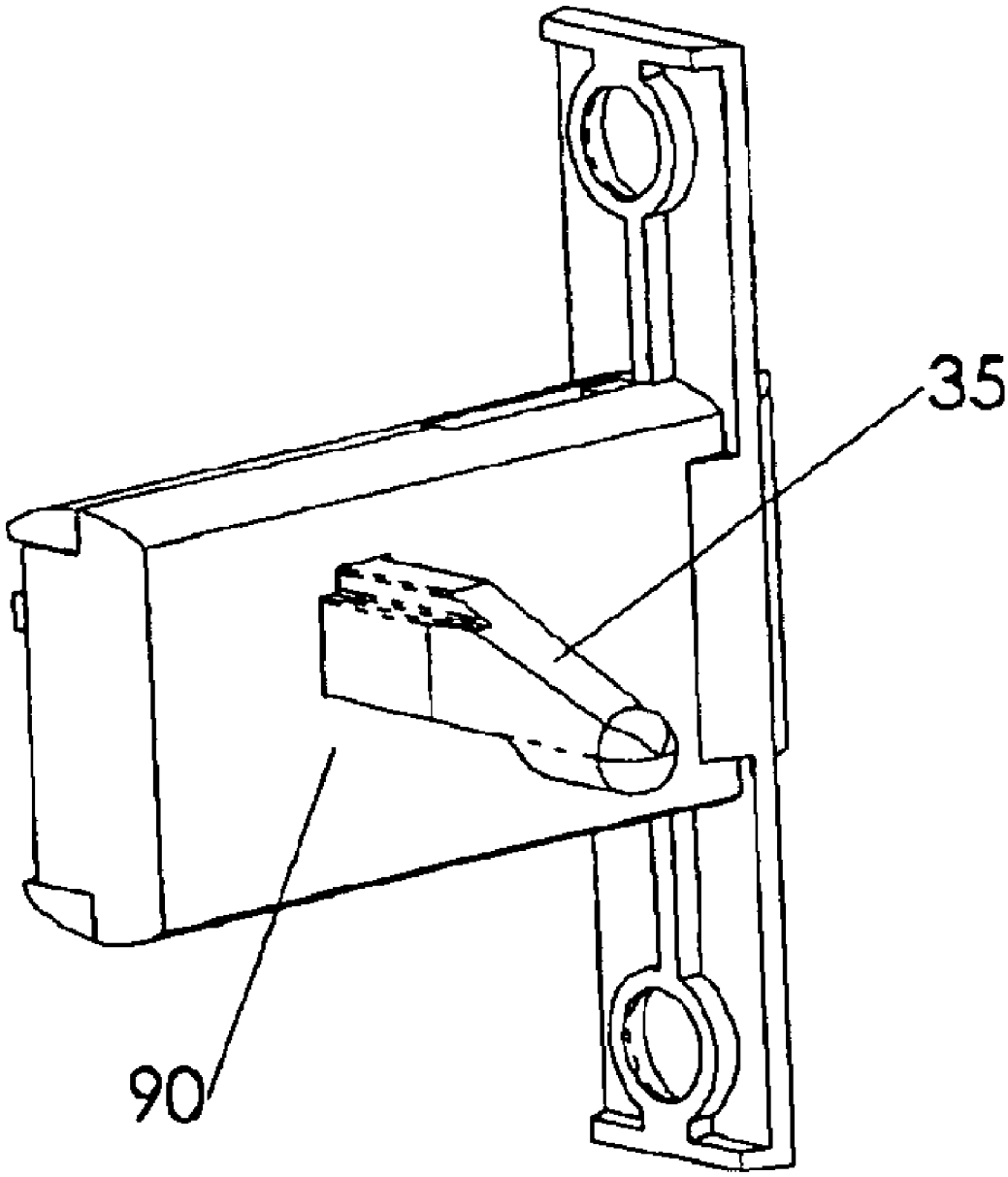
FIG. 20 is an isometric view of the latch bolt assembly illustrating an alternate embodiment of the spindle utilized for "pull" actuation of the bolt.

An alternative single spindle version of the latch mechanism is illustrated in FIGS. 18, 19 and 20. A single spindle 35 with an orientation slot 31 is mounted to housing 90 and cover 80. The orientation slot 31 aligns with a corner obstruction 39 in housing 90 to maintain proper alignment of the spindle 35 with respect to the housing 90. The spindle 35 further includes spindle notches 37 which may be engaged by an external actuator (not shown) to draw the spindle 35 out of the housing 90, in the direction of the spindle notches 37. When drawn out, the inclined surface of the spindle 35 engages an inclined surface of the bolt 20 to cause the bolt 20 to retract into the housing 90. Spindle 35 is thus "pulled" to cause retraction of the bolt 20.

It is also anticipated that the latch bolt mechanism could be modified so that the detail in the bolt 20 for receiving the lock 60 could be carried in the cover 50 or housing 40 and the lock 60 could be mounted on and carried with the bolt 20 for both movement with and movement transverse to the line of travel of the bolt 20. Movement of the lock between its locked and unlocked positions could be by mechanical means, such as inclusion of an additional longitudinal slot in the housing 40 or cover 50, aligned with the line of travel of the bolt 20, or by other means (magnetic, etc.).

The present invention is symmetrical for use on both right and left handed doors without installer modification and is compact enough to be used on virtually any door. Further, the slide actuation method allows push pull actuation in a mortise application. Actuation members can be oriented in many different ways to translate the spindle, allowing for virtually any type of external actuation method to be secured to the latch bolt mechanism 10, including push, pull, lift, trigger, and rotational external actuators.

What is claimed is:

1. A latch bolt mechanism comprising:

a. an elongated housing with a transverse opening for receiving two opposing spindles;

b. an elongated bolt having a transverse opening for receiving two spindles with opposite facing inclined surfaces defined therein, slideably mounted within the housing for movement between an extended position partially extended from the housing and a retracted position fully retracted within the housing; and c. two spindles each having an inclined surface slideably mounted through the openings in the bolt and housing with the inclined surface of each spindle facing the other and in operative interaction with a corresponding inclined surface of the bolt, such that movement of a spindle actuates movement of the bolt between the retracted position and extended position.

2. The latch bolt mechanism of claim 1 wherein one end of at least one spindle includes means for engaging an external actuator such that pushing the spindle through the housing into engagement with the bolt causes the bolt to move between the retracted and extended positions.

3. The latch bolt mechanism of claim 1 wherein one end of at least one spindle includes means for engaging an external actuator such that pulling the spindle through the housing into engagement with the bolt causes the bolt to move between the retracted and extended positions.

4. The latch bolt mechanism of claim 1 further comprising bias means for biasing the bolt in its extended position until actuated by the spindle to its retracted position.

5. The latch bolt mechanism of claim 1 further including a bias means for biasing the bolt in its extended position until actuated by movement of a spindle.

6. The latch bolt mechanism of claim 1 wherein the housing has an end wall and further including at least one spring mounted between and in engagement with the one end of the bolt and the end wall of the housing.

7. A mortise latch bolt mechanism comprising:

a. an elongated housing with a transverse opening for receiving two opposing spindles;

b. an elongated bolt having a transverse opening for receiving two spindles with opposite facing inclined surfaces defined therein, slideably mounted within the housing for movement between an extended position partially extended from the housing and a retracted position fully retracted within the housing;

c. two spindles each having an inclined surface slideably mounted through the openings in the bolt and housing with the inclined surface of each spindle facing the other and in operative interaction with a corresponding inclined surface of the bolt, such that movement of a spindle actuates movement of the bolt between the retracted position and extended position; and d. bias means for biasing the bolt in its extended position until actuated by movement of a spindle.

8. The latch bolt mechanism of claim 7 further comprising a lock means for securing the bolt in its extended position.

9. The latch bolt mechanism of claim 7 wherein:

a. the housing includes a lock guide for guiding a lock between a locked and unlocked position;

b. the bolt includes a lock channel permitting movement of the bolt between the extended and retracted positions until the lock is actuated, and lock means for operatively engaging a lock when the lock is actuated;

c. a lock mounted to the lock guide actuated between an unlocked position and a locked position in operative engagement with the lock means of the bolt.

10. The latch bolt mechanism of claim 9 wherein:

a. the lock guide is transversely aligned with the line of travel of the bolt and slideably engages the lock;

b. the lock includes placement stops and is slideably mounted to the lock guide for movement between its unlocked and locked positions;

c. the lock means is a recess in the bolt for engaging the placement stops of the lock upon movement of the lock to the locked position.

11. The latch bolt mechanism of claim 9 wherein the inclined surfaces of the spindles are at an angle of approximately 40 degrees from the line of travel of the bolt.

12. A mortise latch bolt mechanism comprising:

a. an elongated housing having a transverse opening for receiving a pair of opposing spindles and further having a transverse lock guide for guiding a lock between a locked position and an unlocked position;

b. an elongated bolt having a longitudinal side channel with a transverse recess at one end and further having a transverse opening through the bolt for receiving a pair of spindles, with the opening defining a pair of opposite facing inclined surfaces, wherein the bolt is slideably mounted within the housing for movement between an extended position partially extended from the housing and a retracted position fully retracted within the housing;

c. a pair of spindles each having an inclined surface, slideably mounted through the bolt and housing openings from opposite sides of the housing, with the inclined surfaces of each spindle generally facing the other and each inclined surface in operative interaction with a corresponding inclined surface of the bolt, such that movement of a spindle actuates movement of the bolt between the retracted position and extended position;

d. bias means for biasing the bolt in its extended position until actuated by movement of a spindle; and e. a lock slideably mounted to the lock guide and actuated between an unlocked position within the side channel of the bolt and a locked position within the transverse recess of the bolt.

13. The latch bolt mechanism of claim 12 further comprising a catch means for securing the lock in its locked or unlocked position until application of an external force on the lock.

14. A mortise latch bolt mechanism comprising:

a. an elongated housing having a transverse opening for receiving a pair of opposing spindles and a longitudinal inward facing side channel with a transverse recess at one end for receiving a lock;

b. an elongated bolt having a transverse opening through the bolt for receiving a pair of spindles with the opening defining a pair of opposite facing inclined surfaces, and further having a transverse lock guide for guiding a lock between a locked position and an unlocked position, wherein the bolt is slideably mounted within the housing for movement between an extended position partially extended from the housing and a retracted position fully retracted within the housing;

c. a pair of spindles each having an inclined surface, slideably mounted through the bolt and housing openings from opposite sides of the housing, with the inclined surfaces of each spindle generally facing the other and each inclined surface in operative interaction with a corresponding inclined surface of the bolt, such that movement of a spindle actuates movement of the bolt between the retracted position and extended position;

d. bias means for biasing the bolt in its extended position until actuated by movement of a spindle;

e. a lock slideably mounted to the lock guide and actuated between an unlocked position within the side channel of the housing and a locked position within the transverse recess of the housing.

f. means for actuating the lock between the locked and unlocked positions.

* * * * *